US007249837B2

(12) United States Patent
Abramek

(10) Patent No.: US 7,249,837 B2
(45) Date of Patent: Jul. 31, 2007

(54) PRINTING ON FLOCKED PAPER AND FILMS

(76) Inventor: Edward T. Abramek, 200 Founders Dr., Woonsocket, RI (US) 02895

( * ) Notice: Subject to any disclaimer, the term of this patent is extended or adjusted under 35 U.S.C. 154(b) by 197 days.

(21) Appl. No.: 10/436,215

(22) Filed: May 12, 2003

(65) Prior Publication Data

US 2004/0228989 A1 Nov. 18, 2004

(51) Int. Cl.
*B41J 2/01* (2006.01)

(52) U.S. Cl. ..... 347/105; 347/112; 347/159

(58) Field of Classification Search ..... 428/90, 428/97, 96, 914, 33, 32.16; 347/5, 105
See application file for complete search history.

(56) References Cited

U.S. PATENT DOCUMENTS

| | | | | |
|---|---|---|---|---|
| 3,903,331 | A | 9/1975 | Klein | |
| 4,064,297 | A | 12/1977 | Power et al. | |
| 4,314,813 | A | 2/1982 | Masaki | |
| 4,687,527 | A | 8/1987 | Higashiguchi | |
| 4,734,336 | A * | 3/1988 | Oliver et al. | 428/537.5 |
| 4,741,791 | A | 5/1988 | Howard et al. | |
| 4,980,216 | A | 12/1990 | Rompp | |
| 5,059,452 | A | 10/1991 | Squires | |
| 5,153,964 | A | 10/1992 | Gelardi et al. | |
| 5,224,987 | A * | 7/1993 | Matrick | 106/31.43 |
| 5,457,843 | A | 10/1995 | Gelardi et al. | |
| 5,494,733 | A * | 2/1996 | Koike et al. | 428/32.16 |
| 5,534,099 | A * | 7/1996 | Yamamoto | 156/230 |
| 5,543,195 | A * | 8/1996 | Squires et al. | 428/90 |
| 5,735,521 | A * | 4/1998 | Klimpert | 273/157 R |
| 5,766,397 | A | 6/1998 | Jones | |
| 5,981,021 | A * | 11/1999 | McCulloch | 428/97 |
| 6,224,707 | B1 * | 5/2001 | Lion | 156/230 |
| 6,350,504 | B1 | 2/2002 | Alboom et al. | |
| 2004/0053001 | A1 * | 3/2004 | Abrams | 428/90 |

FOREIGN PATENT DOCUMENTS

GB 2159730 A * 12/1985

* cited by examiner

*Primary Examiner*—Cathy Lam
*Assistant Examiner*—Timothy M. Speer

(57) ABSTRACT

A flocked substrate that can be printed in non-impact printers and photocopiers, including bubble jet, piezoelectric and LaserJet printers, a method of printing on flocked substrate using that flocked substrate, and a jigsaw puzzle made using the printed flocked substrate, with an adhesive backing.

18 Claims, 2 Drawing Sheets

PRINTING ON FLOCKED PAPER AND FILMS

TECHNICAL FIELD

The technical field of this invention concerns printing on flocked paper and films.

BACKGROUND

Flocking is the well-known process of adhering one end of a relatively short length of fiber, generally acrylic, nylon, rayon, other plastic or cotton to the substrate to be flocked. In the typical flocking process, the substrate is unwound from a roll, an adhesive is applied to a surface and pre-cut flock fibers are sifted onto the adhesive coated surface under an electrostatic charge so that the flock fibers stand on end. The flocked substrate is then dried and wound into a roll. The resulting flocked surface has a soft, velvety feel that is frequently used as linings for display cases for personal items such as jewelry, perfume and writing instruments and for packaging, upholstery, apparel and other industrial applications.

Flocked material also can be printed. Known practices typically print on flock adhered to fabric, paper and vinyl and polyester film substrates. Most known printing techniques generally require expensive high speed large volume printing operations and require investment in machinery and labor that is beyond all but significant commercial operations. Currently known practices do not permit such commercial operations or others to conveniently or inexpensively make small runs of printing on flocked paper or films, and do not permit non-commercial operations to print on flocked paper or films.

SUMMARY OF THE INVENTION

The present invention concerns a new type of flocked substrate and method of printing in black and white or color using common non-impact printers, including laserjet, desktop printers attached to work stations, or personal computers, as well as on photocopy machines. The substrate preferably is 40 to 60 pound kraft paper, or 4 to 9 point Latex saturated paper, 9 to 20 point coated one side paperboard or a vinyl or polyester film. The flocked substrate may include a pressure sensitive adhesive applied to the back of the substrate. If a pressure sensitive adhesive is used, it preferably is an acrylic or solvent based adhesive, and preferably will be covered with a removable protective sheet, preferably made of lightweight kraft paper.

As in traditional flocking process, the substrate is coated with a flocking adhesive, such as an acrylic, flocked with common fibers, such as acrylic, cotton, rayon, polyester or nylon, dried in a curing oven and wound into rolls. The sheets are cut into sizes commonly used in printers. The user then may print on the flocked side of the substrate using a non-impact printer, such as one attached to a computer, including a desktop personal computer. The flocked substrate also may be printed using a photocopy machine. The user can then remove the protective sheet and adhere the printed flocked substrate to a variety of surfaces.

The invention includes a jigsaw puzzle custom made by the user by printing on the flocked substrate, adhering the printed flocked substrate to a pre-cut jigsaw puzzle and cutting the printed flocked substrate along the lines in the pre-cut jigsaw puzzle. The invention thus provides an inexpensive method for users to print on flocked substrates, and to custom make jigsaw puzzles. The material the user can print on the flocked substrate is virtually limitless, and includes images, digital photographs and virtually any image or data that can be sent to a computer printer or copied on a photocopy machine. The user can personalize jigsaw puzzles and other items with images or logos created by or for the user, such as personal photographs, slogans or designs. An advantage of this invention is that the images can be presented on a flocked surface, which previously has been too costly for a customized or a small number of prints, and inaccessible for all but large-scale commercial operations.

BRIEF DESCRIPTION OF THE DRAWINGS

These and other features, aspects and advantages of the present invention will become better understood with reference to the following description, appended claims and accompanying drawings where:

DETAILED DESCRIPTION OF THE DISCLOSURE

Figure 1:
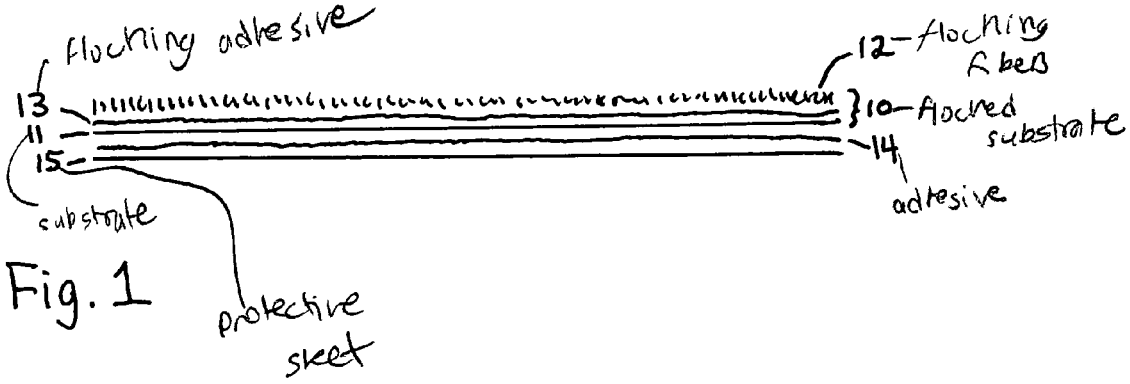
FIG. 1 is an exploded side view of a flocked substrate with adhesive back and protective sheet.

As shown in FIG. 1, well known flocked substrate 10 comprises substrate 11, flocking fibers 12 and a flocking adhesive 13 to adhere the flocking fibers to the substrate. Substrates can be a wide variety of materials, including fabric, paper, vinyl and polyester. This invention concerns the printing on flocked paper, vinyl and polyester. Paper can include a wide variety of papers, including 9 to 20 point coated one side and solid bleached sulfate paperboard, 4 to 9 point latex saturated paper, 40 to 60 pound kraft paper. Vinyl and polyester substrates include vinyl and polyester film substrates of the types known in the flocking industry. The invention disclosed herein works with a wide variety of substrates, with substrate thickness a consideration, depending on the thickness of the flocked material and the capacity of the particular printer to be used in printing. Best results were obtained with 6 Pt. latex saturated paper, though Kraft paper is less expensive.

Flocking fibers 12 also include a wide range of materials, including acrylic, cotton and polyester, but nylon and rayon work well. As described below, various trials were run with rayon flocking fibers, some of which were random cut and others which were precision cut, and mixed in different ratios of precise and random cut fibers. Flocking fibers of nylon, with precision cut, and cotton flocking fibers were also used. Blends of random and precision cut fibers were found superior to purely precision cut flocking, as the precision cut nylon produced poor quality prints with visible resolution lines. Similarly, cotton, while less expensive than other flocking materials, produced poor print quality, with visible resolution lines.

The poorer print quality with cotton may be caused by greater absorption of the printing ink in the cotton fibers, resulting in a blurring of the ink dots from the printers. While many uses require more precise printing, as with diagrams or designs having distinct lines, or with photographs of realistic images, the blurring may be useful in printing of other works, such as some types of fine art, or images displaying blurred or unfocused presentations.

The flocking fibers 12 are adhered to the substrate 11, with a flocking adhesive 13, which typically is a white acrylic latex adhesive, though a variety of adhesives, including ethyl vinyl acetate and others, are available and known to those experienced in the flocking art. The flocked substrate is prepared using well known techniques of sifting the pre-cut flocked fibers onto an adhesive coated substrate under an electrostatic charge so that the flocked fibers stand on end. As also is well know, the flocked substrate preferably is dried and wound onto a roll, or may be sent directly to be cut to size, without winding.

The flocked substrate preferably is cut into standard printer sizes. When manufactured for use, this invention contemplates production of a wide variety of sizes for use in printers and photocopy machines, including standard 8½"×11", A-4, 11"×14", 11"×17" and larger sheets as can be used in home and office printers and photocopy machines. Smaller size sheets may also fit into printers and photocopy machines, and, preferably within the limits of known printers and photocopy machines, the flocked substrates can be cut to appropriate sizes.

Known printers used with computers and in offices are classified generally as impact and non-impact printers. This invention for printing on flocked substrates is intended to be used with non-impact printers, since impact printers, such as dot matrix printers and traditional typewriters could disrupt or damage the flocking fibers, and may not produce satisfactory results.

Non-impact printers include bubble jet printers, in which ink is ejected from bubble ports by heating of the fluid until it expands out a port, and by piezoelectric based printers, which eject printing ink from the print head by piezoelectric vibration of crystals. Non-impact printers also include laser jet printers, which use electrostatic charge to selectively deposit a dry powder on the print surface, and fixes it using heat. Photocopy machines also print using electrostatic charge to selectively deposit dry powder on the print surface, which is fixed using heat. All non-impact printers, including bubble jet, piezoelectric, laser jet and photocopy machines have been applied successfully in this method of printing on flocked material.

In this invention, printers and copies are used with standard manufacturer's supplies, including ink cartridges or toner, as recommended by the respective printer or copier manufacturers, and are used with standard printer settings, though printers and copier may be adjusted to accept thicker flocked substrates if the particular machine has such flexibility. A flocked substrate is fed into the particular printer according to the printer manufacturer's instructions, and can include manual single sheet feed, multiple sheet automatic feed, as is standard in most personal computer printers and photo copy machines.

Details of specific examples of printing on flocked substrates are described below:

EXAMPLE 1

Substrate: #8101 6 Pt. Latex saturated paper.
Adhesive: white acrylic latex adhesive.
Flocking fiber: V80 Flock blend consisting of 80% 1.1 denier, random cut viscose rayon (Majority of fiber lengths are between 0.0025 and 0.020") and 20% 1.5 denier precision viscose rayon with a nominal cut length of 0.020 inches.

Results: Pre-print: very white appearance and soft, low pile hand. Printability: washed out look, macroscopic voids. Had some jamming in the printer due to the high coefficient of friction between the flock and the backside of the sheets. Similar results were obtained using an 18 Pt. C1 S, SBS board (C1S means clay coated one side, and SBS means solid bleached sulfate) substrate, except there was difficulty in automatic sheet fed machines.

EXAMPLE 2

Substrate: #4515 6 Pt. Latex saturated paper.
Adhesive: white acrylic latex adhesive.
Flocking fiber: V85 Flock Bend consisting of 15% 1.1. denier, random cut viscose rayon (Majority of fiber lengths are between 0.0025 and 0.020" and 85% 1.5 denier precision viscose rayon with a nominal cut length of 0.0020 inches.
Results: Pre-print: very white appearance and soft, higher pile. Printability: crisp lines, no blotching or voids, but some minor jamming as in Example 1.

EXAMPLE 3

Substrate: #4515PS 6 Pt. Latex saturated paper with a solvent based pressure sensitive coating and coated kraft release liner.
Adhesive: white acrylic latex adhesive
Flocking fiber: V85 Flock Blend
Results: Pre-print: very white appearance and soft, higher pile. Printability: crisp lines, no jamming.

EXAMPLE 4

Substrate: #4515PSE 6 Pt. Latex saturated paper with a solvent based pressure sensitive coating and coated kraft release liner.
Adhesive: white acrylic latex adhesive
Flocking fiber: V85 Flock blend.
Finished Product was embossed with a smooth roll to give the flock directionality like fur. This reduced the amount of jamming if fed in with the grain of the flock.
Results: Pre-print: very white appearance and soft, higher pile. Printability: crisp lines, no jamming, however the crushed flock produced shadowing. (Shadowing is a slightly different color variation when the sample is viewed from different angles).

EXAMPLE 5

#2593 Beige Random Acrylic flocked paper.
Print Quality was good, and resolution lines were not visible.
Cost is reasonable.
Softness is fair.

EXAMPLE 6

#4126 Natural Precision Nylon flocked paper. natural means undyed. Fiber was 1.5 denier with a cut length of 0.030 inches.
Print Quality was poor, and resolution lines were visible.
Cost is relatively expensive.
Softness is good.

EXAMPLE 7

#2518 white cotton flocked paper:
Print Quality was poor and resolution lines were visible.
Cost is cheap.

As shown in FIG. 1, the flocked paper can include a pressure sensitive adhesive 14 on the unflocked side, and that adhesive can be covered by a removable protective sheet 15. The adhesive 14 is generally well known, and includes such materials as acrylic, rubber based and solvent based adhesives. The protective sheet 15 also is well known and can include thin layers of kraft paper and vinyl or other films. Known release liners also are protective sheets, as the term is used in this specification. The paper substrate 11 generally will have the adhesive applied to the non-flocking side, and the protective sheet placed over the adhesive, prior to the flocking process. If the adhesive and sheet are applied after flocking, the process of applying the adhesive can crush or otherwise damage or contaminate the flocked surface.

Figure 2:
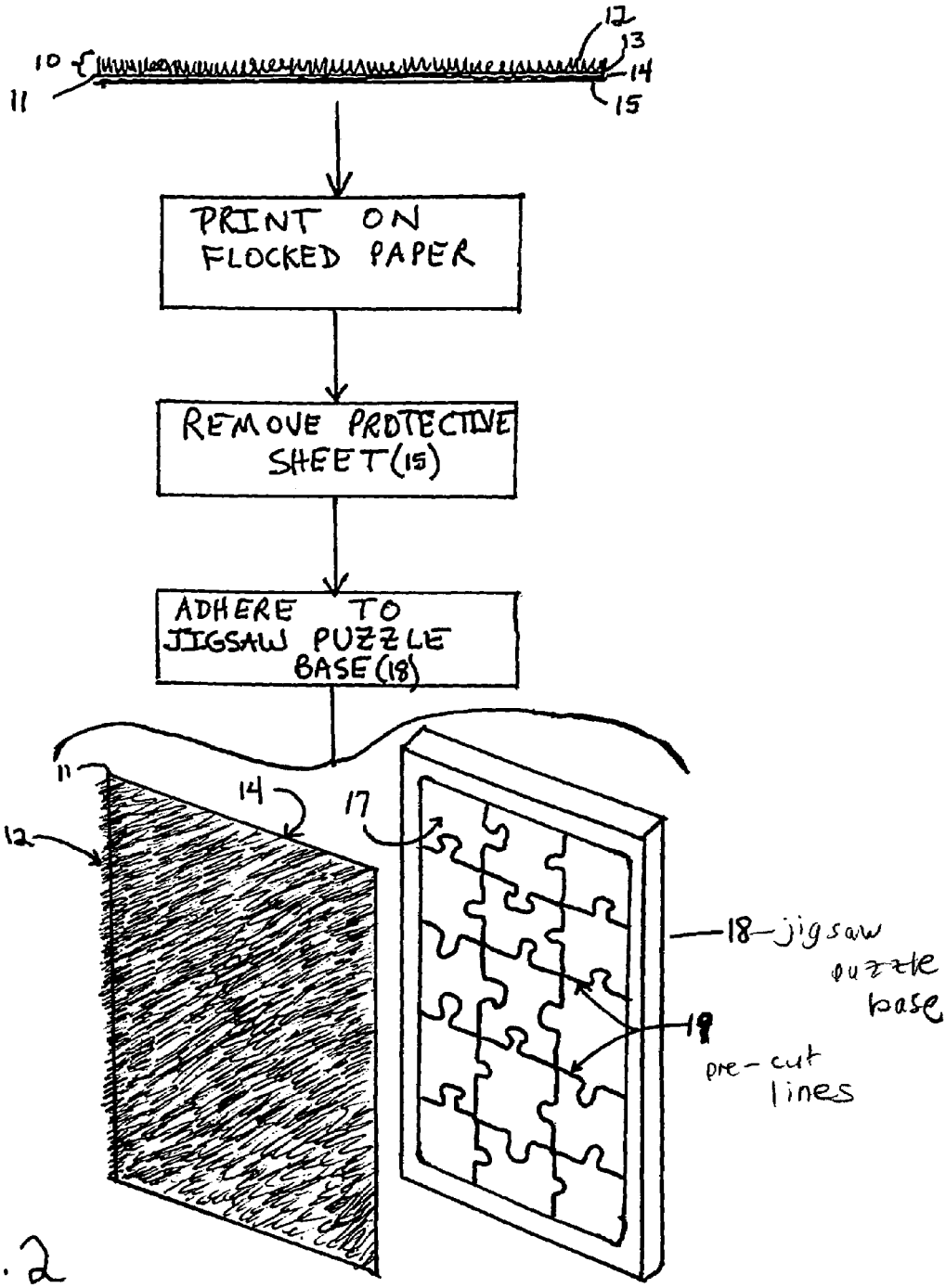
FIG. 2 is an exploded perspective view of a jigsaw puzzle with printed flocked substrate.

As shown in FIG. 2, a jigsaw puzzle can be created with the flocked substrate 10. The flocked substrate 10 with an adhesive 14 and protective sheet 15 is printed. This can be customized by the user, so that the user can create a jigsaw puzzle from the user's favorite picture, logo or design. The protective sheet is removed from the printed flocked substrate and the printed flocked substrate is adhered to a pre-cut jigsaw puzzle base 18. The jigsaw puzzle base can be of a variety of well known jigsaw puzzle materials, including cardboard and wood. The jigsaw puzzle base preferably has pre-cut lines 19, made by such means as die cut, or saw cut in the case of wood, so that the user can customize the jigsaw puzzle without excessive effort. After printed flocked paper is adhered to the jigsaw puzzle base, the user cuts over the pre-cut lines 19, cutting through the printed flocked paper along the pre-cut lines. These cuts generally can be made with utility knives or other common cutting tools. The flocking adhesive 13 and adhesive 14 preferably are compatible, and adhesion may be enhanced by including an additional coating of compatible adhesive 17 on the jigsaw puzzle base.

I claim:

1. A method of printing on a flocked substrate comprising the steps of:

flocking a substrate having a front and a back, with a plurality of flocking fibers, by adhering the flocking fibers to the front of the substrate with a flocking adhesive; and printing on the flocked substrate with a non-impact printer, where the substrate is selected from a group consisting of 9 to 20 point coated one side paperboard, 4 to 9 point latex saturated paper, and 40 to 60 pound kraft paper.

2. The method of claim 1 where the flocking fibers are selected from a group consisting of acrylic fibers, rayon fibers, nylon fibers, polyester fibers and cotton fibers.

3. The method of claim 1 where the non-impact printer is selected from a group consisting of bubble jet printers, piezoelectric based printers, laser jet printers and photocopiers.

4. The method of claim 1 comprising the additional step of:

coating the back of the substrate with a pressure sensitive adhesive.

5. The method of claim 4 comprising the additional step of: covering the pressure sensitive adhesive with a removable protective sheet.

6. The method of claim 5 wherein said additional step of coating the back of the substrate with a pressure sensitive adhesive occurs prior to flocking the substrate.

7. A method of printing on a flocked substrate comprising the step of inserting a flocked substrate into a non-impact printer, the flocked substrate comprising: a substrate with a front and a back; flocking fibers; and a flocking adhesive that adheres the flocking fibers to the front of the substrate, where the substrate is selected from a group consisting of 9 to 20 point coated one side paperboard, 4 to 9 point latex saturated paper, and 40 to 60 pound kraft paper.

8. The method of claim 7, where the flocking fibers are random cut.

9. The method of claim 7, where the flocking fibers are precision cut.

10. The method of claim 9, where the flocking fibers are precision cut fibers with a nominal cut length of between 0.0020 to 0.025 inches.

11. A method of printing on a flocked substrate comprising the steps of: flocking a substrate having a front and a back, with a plurality of flocking fibers, by adhering the flocking fibers to the front of the substrate with a flocking adhesive; and printing on the flocked substrate with a non-impact printer, where the substrate is selected from a group consisting of 9 to 20 point coated one side paperboard, 4 to 9 point latex saturated paper, and 40 to 60 pound kraft paper.

12. The method of claim 11 where the flocking fibers are selected from a group consisting of acrylic fibers, rayon fibers, nylon fibers, polyester fibers and cotton fibers.

13. The method of claim 12 where the non-impact printer is selected from a group consisting of bubble jet printers, piezoelectric based printers, laser jet printers and photocopiers.

14. The method of claim 11 comprising the additional step of:

coating the back of the substrate with a pressure sensitive adhesive.

15. The method of claim 14 comprising the additional step of:

covering the pressure sensitive adhesive with a removable protective sheet.

16. The method of claim 11 wherein said additional step of coating the back of the substrate with a pressure sensitive adhesive occurs prior to flocking the substrate.

17. The method of claim 11, where the flocking fibers are precision cut fibers with a nominal cut length of between 0.0020 to 0.025 inches.

18. The method of claim 11, where the flocking fibers are non-precision cut fibers with a nominal cut length of between 0.0020 to 0.025 inches.

* * * * *